United States Patent [19]

Spector

[11] Patent Number: 4,463,945

[45] Date of Patent: Aug. 7, 1984

[54] EXERCISE MACHINE

[76] Inventor: Donald Spector, 380 Mountain Rd., Union City, N.J. 07087

[21] Appl. No.: 440,609

[22] Filed: Nov. 10, 1982

[51] Int. Cl.[3] ..... A63B 69/16; A63B 69/06

[52] U.S. Cl. ..... 272/73; 272/72; 272/125; 272/130; 272/DIG. 4

[58] Field of Search ..... 272/73, 72, 125, 130, 272/132, DIG. 4; 128/25 R

[56] References Cited

U.S. PATENT DOCUMENTS

| | | | |
|---|---|---|---|
| 1,872,256 | 8/1932 | Denney | 272/73 |
| 2,278,591 | 4/1942 | Sak | 272/72 |
| 2,872,191 | 2/1959 | Gallo, Sr. | 272/73 |
| 3,075,766 | 1/1963 | Büscher | 272/73 |
| 3,606,318 | 9/1971 | Gilstrap | 272/72 X |
| 3,912,265 | 10/1975 | Muir | 272/130 |
| 3,955,655 | 5/1976 | Pornin | 272/130 X |
| 3,966,201 | 6/1976 | Mester | 272/73 X |
| 4,148,479 | 4/1979 | Spector | 272/130 |
| 4,191,370 | 3/1980 | Meyer et al. | 272/130 X |
| 4,313,602 | 2/1982 | Sullivan | 272/132 X |

FOREIGN PATENT DOCUMENTS

| | | | |
|---|---|---|---|
| 2134897 | 2/1973 | Fed. Rep. of Germany | 272/73 |

OTHER PUBLICATIONS

AMF Whitely, TR7000 Exercise Bicycle, 29 Essex St., Maywood, N.J. 07607.

The Tri-Exerciser manufactured in Spain by Beistegui Hermanos, S. A., offered in 1982 by American Express ®.

*Primary Examiner*—Robert A. Hafer
*Assistant Examiner*—Arnold W. Kramer
*Attorney, Agent, or Firm*—Michael Ebert

[57] ABSTRACT

An exercise machine which entails simultaneous peddling and rowing actions to afford a total body workout. The machine includes a stationary bicycle frame having front and rear sections and a beam bridging these sections. A bicycle saddle is supported on an upright post anchored at an intermediate position on the beam, at which position a sprocket wheel is mounted whose axle is coupled to foot pedals engageable by the feet of the seated individual. A front wheel is supported for rotation above ground on the front section, this wheel being linked by an endless chain to the sprocket wheel. The front wheel is engaged by a spring-biased pressure roller imposing an adjustable load thereon to resist the peddling action. Pivotally supported on the front section on either side of the front wheel is a pair of poles terminating in handle bars to be grasped by the seated individual, the poles being joined by a connector so that they swing together. Extending between the post and the pole connector is a hydraulic bar composed of telescoping inner and outer tubes, the bar offering uniform resistance in both directions as the individual rows the joined poles back and forth while concurrently peddling.

7 Claims, 4 Drawing Figures

EXERCISE MACHINE

BACKGROUND OF THE INVENTION

This invention relates generally to exercise machines to enhance physical fitness, and more particularly to a machine which entails concurrent peddling and rowing actions.

To remediate many of the physical fitness problems of the sedentary individual, various forms of exercisers have been contrived to develop muscular strength and endurance. Most exercisers in current use fall either into the isometric or isotonic class. An isometric exerciser functions to sustain a muscular contraction and therefore operates on static tension; whereas an isotonic exerciser, which is adapted to repeatedly raise or lower a weight or other load, brings into play dynamic tension.

From the standpoint of overall physical fitness enhancement, neither isotonic nor isometric forms of exercise are adequate, for these exercises fail to contribute in an appreciable degree to improvements in circulatory-respiratory endurance, an important aspect of well-being.

In recent years, a third training technique has been developed by experts in the physiology of exercise and physical therapy to improve overall physical fitness. This new technique, which combines the best attributes of isotonic and isometric training, has been designated isokinetic training. In isokinetic exercise, maximum dynamic tension is developed throughout a range of motion.

When performing isotonic or isometric exercises, strength development is not achieved equally throughout the range of motion. In isotonic exercise, the magnitude of isotonic resistance must be limited to the largest load that can be moved at the weakest point in some range of motion. This resistance will therefore be less than maximum during the rest of the range and thus will not load the muscle to its full tension-developing capacity in much of its shortening range. Moreover, in isotonic training, the exercise speed is subject to considerable acceleration and is therefore unstable and unpredictable.

On the other hand, isometric exercise takes place against a load which prevents external movement and offers resistance inherently proportional to the muscle's static tension-developing capacity at one shortening length. No dynamic work at all is carried out; hence the intrafiber power developed is inherently restricted.

In my prior Spector U.S. Pat. No. 4,148,479, issued Apr. 10, 1979, there is disclosed a push-pull isokinetic exerciser in the form of a hydraulic bar having telescoping inner and outer tubes provided at their ends with handle pieces. A hydraulic bar of this type offers substantially uniform resistance to motion throughout its entire range of compression and expansion strokes and therefore demands an evenly applied muscular force to effect such motion in either direction of movement. It calls for the effort and work of the isometric technique, while offering the weight resistance of the isotonic method, thereby combining the best aspects of both types of exercise.

An exerciser of the type disclosed in the Spector patent may be held between the hands or between either foot and either hand and then expanded and contracted at virtually any body position, thereby making it possible to exercise almost all body regions and muscle groups. The practical difficulty with an exerciser of this type is that one is able to exercise only one set of muscles at a time, and this may lead to uneven development; for the user tends to favor the hands over the feet.

Stationary bicycle exercisers are known in which the user, sitting on a raised bicycle seat, operates pedals with his feet to turn a front wheel whose rotation is subject to an adjustable resistance to vary the required effort. Such machines are suitable for developing the leg muscles, but afford little exercise to other parts of the body.

Stationary rowing machines are known, such as that disclosed in the Lawton U.S. Pat. No. 2,825,563, in which an individual sitting on a seat slideable on bed rails, graps the handles of pivotally-mounted oars coupled to air cylinders, thereby providing for the simultaneous exercising of back leg and arm muscles.

Also known are exercisers which combine rowing and peddling actions. Thus the "Home-Bike" exerciser manufactured by B. H. Beistegui is provided with swingable handlebars whose back and forth movement by an individual sitting on a bicycle seat is resisted by an adjustable friction pad. A Home-Bike exerciser, in its rowing function, fails to offer substantially uniform resistance to motion throughout its entire range of swing and does not therefore afford the full advantages of isokinetic training.

The following patents represent prior art generally relevant to the present invention:

U.S. Pat. Nos. 3,266,801 (1966), 432,598 (1890), 1,015,071 (1912), and 1,916,714 (1933) deal with rowing exercise machines in which each one is coupled to a fluid cylinder.

U.S. Pat. Nos. 3,966,201 (1976), 2,783,044 (1957), 2,419,998 (1947) and 4,188,030 (1980) disclose various forms of cycle exercisers which include both foot pedals and handlebars.

While rowing machines have made use of hydraulic cylinders coupled to the oars, the nature of these machines is such that the hydraulic cylinders coupled to the outstretched oars may be placed at right angles to the bed on which the rower's seat slides, as in U.S. Pat. No. 1,015,071. In the case of the cycle exercisers disclosed in the prior art, hydraulic cylinders have not been used in connection with the rowing elements, for in this context it is not possible to place the cylinders in the manner heretofore used with rowing machines. In the present invention, a hydraulic cylinder is so placed as to be straddled by the seated individual so as not to interfere with the rowing or peddling activity.

SUMMARY OF INVENTION

In view of the foregoing, the main object of this invention is to provide an exercise machine which entails concurrent peddling and rowing actions and which is adjustable to render the effort demanded by these actions appropriate to the physical condition of the exerciser.

More particularly, an object of this invention is to provide an exercise machine of the above type in which the peddling action causes a front wheel to turn against the uniform resistance offered by a tensioned pressure roller, and in which the rowing action causes back and forth movement of a pair of joined poles against a hydraulic resistance which is uniform in both directions.

In a machine in accordance with the invention, the pressure roller resistance applied to the peddling action and the hydraulic resistance applied to the rowing action are adjustable to meet the particular requirements of the exerciser, thereby avoiding over-exertion. However, as the condition of the exerciser improves with continued exercise, these resistances may be changed to increase the effort that must be exerted to operate the machine.

A significant advantage of an exercise machine in accordance with the invention is that it affords a total workout which acts to tone and strengthen all major muscle groups, as well as the heart and circulatory system.

Also an object of the invention is to provide a machine which may be mass-produced at low cost, and which is efficient, safe and reliable in operation.

Briefly stated, these objects are accomplished in an exercise machine which entails simultaneous peddling and rowing actions to afford a total body workout. The machine includes a stationary bicycle frame having front and rear sections and a beam bridging these sections. A bicycle saddle is supported on an upright post anchored at an intermediate position on the beam, at which position a sprocket wheel is mounted whose axle is coupled to foot pedals engageable by the feet of the seated individual. A front wheel is supported for rotation above ground on the front section, this wheel being linked by an endless chain to the sprocket wheel. The front wheel is engaged by a spring-biased pressure roller imposing an adjustable load thereon to resist the peddling action. Pivotally supported on the front section on either side of the front wheel is a pair of poles terminating in handle bars to be grasped by the seated individual, the poles being joined by a connector so that they swing together. Extending between the post and the pole connector is a hydraulic bar composed of telescoping inner and outer tubes, the bar offering uniform resistance in both directions as the individual rows the joined poles back and forth while concurrently peddling.

OUTLINE OF DRAWINGS

For a better understanding of the invention as well as other objects and further features thereof, reference is made to the following detailed description to be read in conjunction with the accompanying drawings, wherein.

Figure 4:
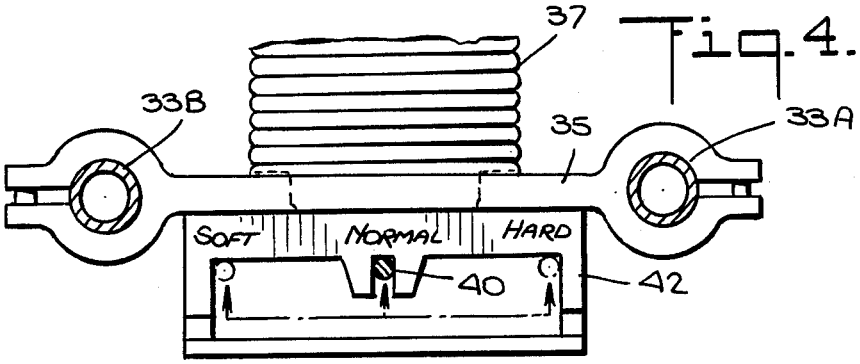
Figure 3:
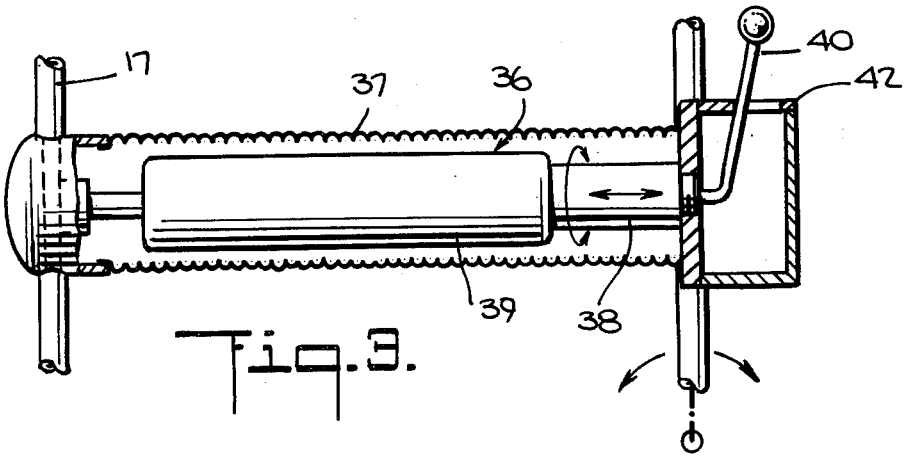

FIG. 3 schematically illustrates the manner in which the hydraulic bar operates; and FIG. 4 shows the damping adjustment plate for the hydraulic bar.

DESCRIPTION OF INVENTION

Figure 1:
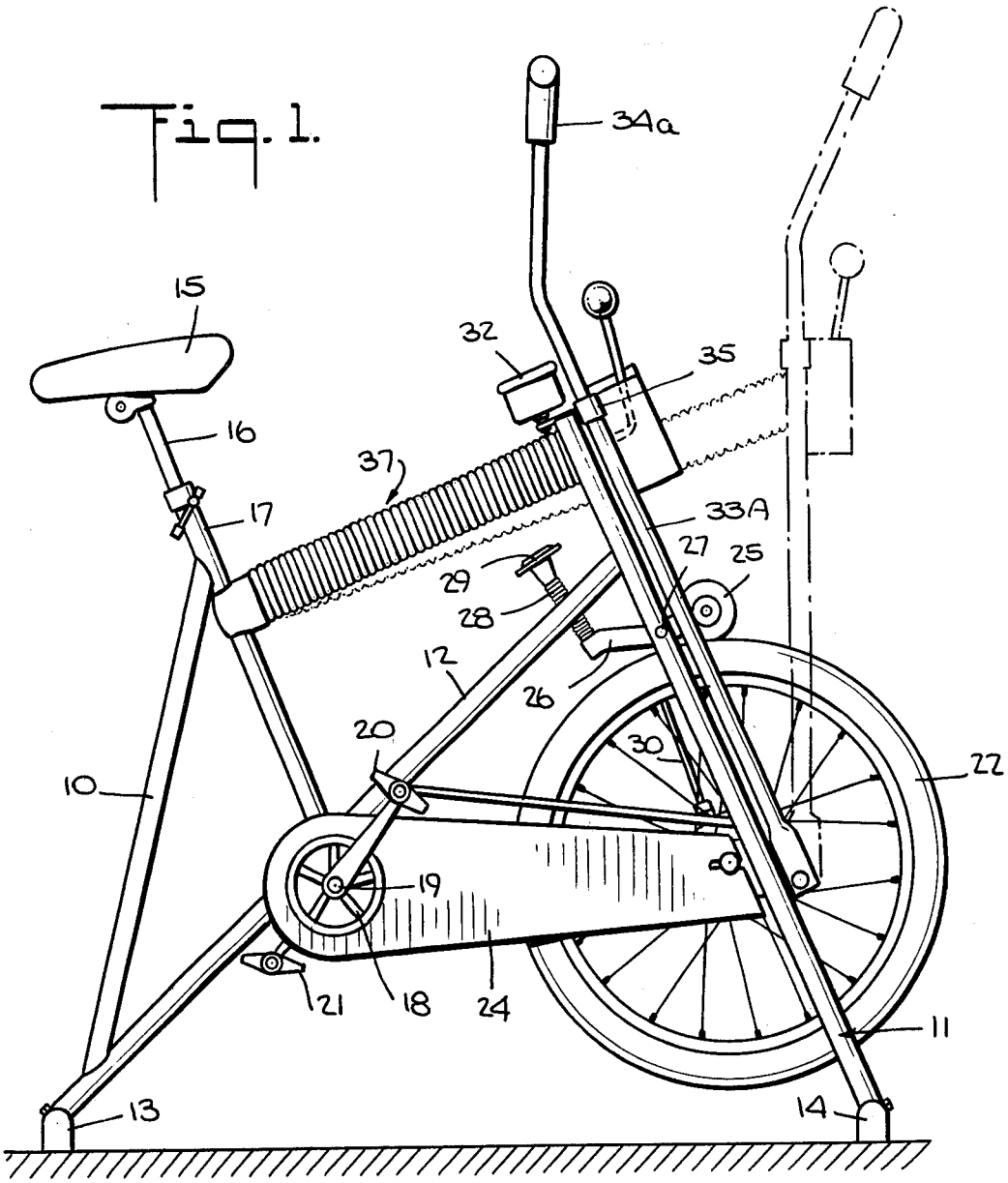
FIG. 1 is an elevational view of an exercise machine in accordance with the invention.
Figure 2:
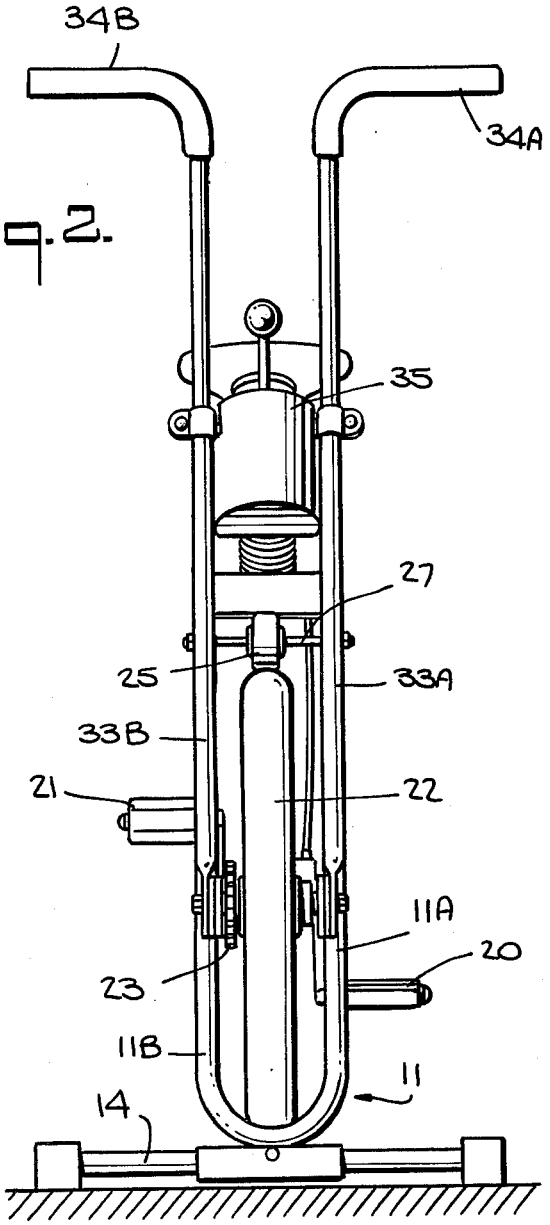
FIG. 2 is a front view of the machine.

Referring now to FIGS. 1 and 2, an exercise machine in accordance with the invention includes a stationary bicycle frame having a rear section 10, a front section 11 and a beam 12 bridging these sections. Rear section 10 rests on a transverse ground bar 13, and front section 11 rests on a transverse ground bar 14 whose ends are padded to resist displacement of the machine and to avoid scratching the floor.

The invention is not limited to a stationary frame of the type illustrated in the drawing, for any existing bicycle frame may be modified to render it stationary and to include those features necessary to the invention. In practice, the frame may be made of stainless steel tubes which are welded together, although lighter weight, high-strength metal may also be used to create the necessary structure.

A standard bicycle saddle 15 is mounted on a pipe 16 telescopically received at an adjustable position in an upright hollow post 17 whose lower end is anchored on beam 12 at an intermediate position thereon. Supported for rotation at this same position is a sprocket wheel 18 whose axle 19 is joined at either end to foot pedals 20 and 21. Thus, an individual seated on saddle 15 can engage the pedals with his feet.

Front section 11, as best seen in FIG. 2, is yoke-shaped and serves to support a front wheel 22 between its parallel arms 11A and 11B at a position raised above ground. This wheel is linked by an endless sprocket chain 23 to sprocket wheel 18, the sprocket chain being protectively covered by a shield 24. In practice, instead of a conventional bicycle wheel, use may be made of a flywheel.

The periphery of front wheel 22 is engaged by a pressure roller 25. This roller is supported for rotation at the end of a lever 26 pivotally mounted on a pivot pin 27 whose ends are secured to the arms of front section 11 at an intermediate point thereon. The other end of lever 26 is coupled to a tension spring 28 whose tension is adjustable by means of a control knob 29 mounted on beam 12.

The axle of front wheel 22 is coupled by a cable 30 to a speedometer or tachometer 32 mounted at the upper end of front frame section 11 so that an exerciser can, when peddling, read the rate of rotation and thereby gauge his effort. The tension of pressure roller 25 is adjustable by the exerciser to vary the load imposed on the front wheel, and hence the effort he must exert to rotate this wheel.

Thus the peddling action can be made more or less strenuous in keeping with the physical condition of the exerciser. As the physical fitness of the exerciser improves with continued exercise, he may increase roller tension to further strengthen his leg muscles.

Pivotally connected to arms 11A and 11B of the front section 11 is a pair of poles 33A and 33B whose upper ends terminate in handlebars 34A and 34B, the pivot points being adjacent the hub of front wheel 22. Poles 33A and 33B are strapped together by a transverse connector 35. Thus an exerciser, seated in saddle 15, is able, by grasping handlebars 34A and 34B, to then swing the strapped together poles back and forth, toward and away from the front section of the frame.

Extending between pole connector 35 and post 17 is a hydraulic bar 36 (see FIG. 3, which is protectively concealed by a tubular bellows 37 of flexible plastic material having an accordion formation. Bar 36 may be of the type disclosed in the above-noted Spector patent having an inner tube 38 telescopically receivable within an outer tube 39. The inner tube is sealed at both ends to define an oil-filled chamber having a piston disposed therein whose actuating rod projects from the end of the inner tube and is attached to the far end of the outer tube. This piston is provided with flap valves that alternately allow oil to pass through the piston in one direction only and act effectively as a throttle to produce a damping action resisting the compression of the hydraulic bar or the expansion thereof.

The hydraulic bar is preferably in the form of a conventional automotive shock absorber of the type in which the inner tube is not only axially shiftable in either direction relative to the outer tube, but also is rotatable relative to the outer tube, so that when the inner tube is fully inserted within the outer tube and then rotated, the rotation acts to adjust an internal valve to an extent determined by the degree of rotation. This internal valve adjusts the hydraulic flow path to produce a desired degree of damping. In installing an automotive shock absorber of this type, the inner tube is first rotated to a setting providing the desired degree of damping, and then fixedly attached to the chassis of the vehicle to maintain this setting.

In the present invention, the outer tube 39 is attached to post 17, whereas the inner tube 38 is attached to a crank arm 40. Arm 40 makes it possible to rotate the inner tube relative to the fixedly held outer tube and to lock it at a desired angular position in a notched plate 42, shown separately in FIG. 4, so that three different settings are available: Hard, Normal and Soft, affording different degrees of damping.

Thus when the exerciser rows the linked poles back and forth, he encounters in either direction of motion hydraulic resistance which is uniform throughout the strokes, the resistance being determined by the setting of crank arm 40 which controls hydraulic damping.

In practice, an electronic or other indicator (not shown) may be coupled to the swinging poles to provide a reading of swing rate. Alternately, since bellows 37 act to periodically pressurize the air in the confined annular air space defined between the hydraulic bar and the bellows, the bellows may be provided with a whistle (not shown) that will produce audible pulses at a periodicity that depends on the swing rate, so that the faster the swing rate, the higher the pulse frequency.

While there has been shown and described a preferred embodiment of an exercise machine in accordance with the invention, it will be appreciated that many changes and modifications may be made therein without, however, departing from the essential spirit thereof.

I claim:

1. An exercise machine which entails simultaneous peddling and rowing actions to afford a total body workout, the machine comprising:

A a stationary bicycle frame having front and rear sections and a beam bridging these sections;

B an upright post anchored at an intermediate position of the beam to support a saddle;

C a sprocket wheel mounted for rotation on said beam and provided with foot pedals;

D a front wheel support at a raised position for rotation on said front section, said wheel being linked by an endless chain to said sprocket wheel whereby a user seated in the saddle with his feet on the pedals, is able to turn the front wheel;

E a pair of poles joined together by a transverse connector and pivotally mounted on said front section on either side of said front wheel, said poles terminating in handle bars graspable by the seated user who can then row the poles to execute back and forth strokes relative to the front section; and F a hydraulic bar having an oil-filled inner tube which is telescopically received in an outer tube, the axial movement in either direction being damped by the flow of oil to offer resistance to said movement, said bar being extended between the connector and the post to uniformly resist movement of the poles in back and forth strokes.

2. A machine as set forth in claim 1, further including a tubular bellows protectively surrounding the bar.

3. A machine as set forth in claim 1, further including means to impose an adjustable load on the front wheel to resist rotation thereof.

4. A machine as set forth in claim 3, wherein said means is a pressure roller which engages the periphery of the wheel, the roller being mounted at one end of a lever whose other end is coupled to an adjustable tension spring.

5. A machine as set forth in claim 1, wherein said hydraulic bar includes means operated by rotation of the inner tube relative to the outer tube to adjust the degree of oil flow and thereby the damping of the bar, and control means coupled to the inner tube to effect such rotation.

6. A machine as set forth in claim 5, wherein said control means is selectively settable at a plurality of damping positions.

7. A machine as set forth in claim 1, further including a speedometer coupling to said front wheel.

* * * * *